United States Patent [19]

Seltzer et al.

[11] 3,940,183

[45] Feb. 24, 1976

[54] BODY SUPPORT PANEL AND MAT MADE THEREFROM

[76] Inventors: Samuel M. Seltzer, 85 Athens Road, Short Hills, Millburn, N.J. 07078; Saul Dennison, 7 Wedgewood Drive, West Orange, N.J. 07052

[22] Filed: Dec. 4, 1974

[21] Appl. No.: 529,337

[52] U.S. Cl. ..... 297/453; 5/347
[51] Int. Cl.[2] ..... A47C 7/02
[58] Field of Search ..... 5/347; 297/453

[56] References Cited

UNITED STATES PATENTS

| | | | |
|---|---|---|---|
| 1,982,516 | 11/1934 | Holmested | 297/453 X |
| 3,167,353 | 1/1965 | Crane | 297/453 |
| 3,391,413 | 7/1968 | Crane et al. | 297/453 X |

*Primary Examiner*—James C. Mitchell
*Attorney, Agent, or Firm*—Friedman & Goodman, Esqs.

[57] ABSTRACT

A car seat is described which includes a panel in the form of a substantially rectangular sheet of plastic material having seat and back portions connected to each other by an integral hinge. The seat and back portions each have a major central area formed with an array of T-shaped elements arranged in columns and rows and each having a T-shaped supporting surface. The T-shaped elements of adjacent rows are staggered and intermeshed to form a lattice of elongate substantially uniform width channels each extending about the periphery of an associated T-shaped section and oriented parallel to one of the directions of the rows and columns. The continuity between the channels aligned along the directions of said rows and channels is repeatedly interrupted by the T-shaped sections. A continuous stiffening bead is provided about each central area to define a peripheral channel open in the direction of the supporting surfaces. An optional stiffening wire may be disposed within the peripheral channel before the panel is covered with a mesh material which is connected to the latter after a peripheral strip of binding material is folded over to cover the edges of the panel and the mesh material. When the mesh material abuts against the T-shaped surfaces of the elements, the mesh material covers the opening of the elongate channel and prevents the stiffening wire from moving out therefrom.

13 Claims, 7 Drawing Figures

BODY SUPPORT PANEL AND MAT MADE THEREFROM

BACKGROUND OF THE INVENTION

This invention generally relates to support panels for use as ventilated support mats, and more specifically to such panels which are suitable for use in car seats and seats made therefrom.

Ventilated pads for seats of automobiles, trucks, and other motor vehicles, are extensively used, particularly over long distance trips. Such pads or mats are intended to provide sufficient ventilation around the driver of the vehicle to prevent excessive perspiration and to increase the general comfort of the driver.

Numerous ventilated pads of the type generally under discussion are known in the prior art. However, many of these have disadvantages. For example, some pads are excessively flexible and do not provide the requisite local rigidity required to adequately support the driver. Pads which do not have the requisite rigidity tend to excessively deform and this decreases the ventilation through the seat as well as provides less support to the driver with attendant added discomfort. Other seats have complex constructions and therefore are expensive to manufacture. Some seats provide the resiliency support by the use of springs or other types of resilient materials which cooperate with a basic seat frame. Because many of these known car seats include frames or panels which do not in and of themselves provide the requisite rigidity, additional means must be utilized, such as stiffening wires which extend through the frame of the seat.

SUMMARY OF THE INVENTION

Accordingly, it is an object of the present invention to provide a panel for use in a ventilated body support mat which does not have the above described disadvantages associated with comparable known devices.

It is another object of the present invention to provide a support panel which is simple in construction and economical to manufacture.

It is still another object of the present invention to provide a support panel of the type under discussion which is made from a relatively thin sheet of plastic material but which is formed in a manner to enhance the rigidity thereof to provide the requisite support to a person resting on the panel.

It is yet another object of the present invention to provide a support panel of the type suggested in the above objects which does not require additional stiffening means to provide desired rigidity of the panel when the latter is formed from a relatively thin sheet of resilient plastic material.

It is a further object of the present invention to provide a car seat which includes a panel as suggested above which is formed from a plastic sheet of material provided over the surface area thereof with an array of T-shaped elements arranged in rows and columns and which are staggered and intermeshed to form a lattice of channels, with the continuity between channels aligned along the directions of said rows and columns being repeatedly interrupted by the T-shaped sections to enhance the stiffness of the panel and prevent excessive flexing thereof along all directions of the panel.

It is still a further object of the present invention to provide a support panel of the type set forth in the last object, wherein the lattice of channels permits the flow therethrough of ventilating air.

It is yet a further object of the present invention to provide a panel as in the last object wherein holes are formed in the T-shaped surfaces associated with the T-shaped elements in one of the faces of the panel to still further enhance the ventilation or flow of air through the panel.

It is an additional object of the present invention to provide a car seat which utilizes one or two above suggested panels to further enhance the rigidity of the car seat.

In order to accomplish the above objects, as well as others which will become apparent hereafter, a support panel for use as a ventilated body support mat comprises an array of T-shaped elements arranged in columns and rows. The T-shaped elements extend between and collectively define two spaced substantially parallel faces of the panel. Each of the T-shaped elements has a T-shaped surface disposed in one of said faces and has wall portions normal to said faces extending from the periphery of said T-shaped surface in said one face to said other face. Elongate connecting portions in the other of said faces are provided extending between said wall portions and connecting adjacent T-shaped elements. The T-shaped elements in adjacent rows are staggered and intermeshed to form a lattice of elongate substantially uniform width channels extending about the peripheries of the T-shaped sections and oriented parallel to one of the directions of said rows and columns. The continuity between said channels aligned along the directions of said rows and columns are repeatedly interrupted by said T-shaped sections. In this manner, the stiffness of the panel is enhanced and excessive flexing thereof is prevented along all directions along said panel including the longitudinal and transverse directions of said columns and rows respectively when a person is supported on the mat, while providing paths which permit the flow of ventilating air through said channels.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DESCRIPTION OF THE PREFERRED EMBODIMENTS

Figure 1:
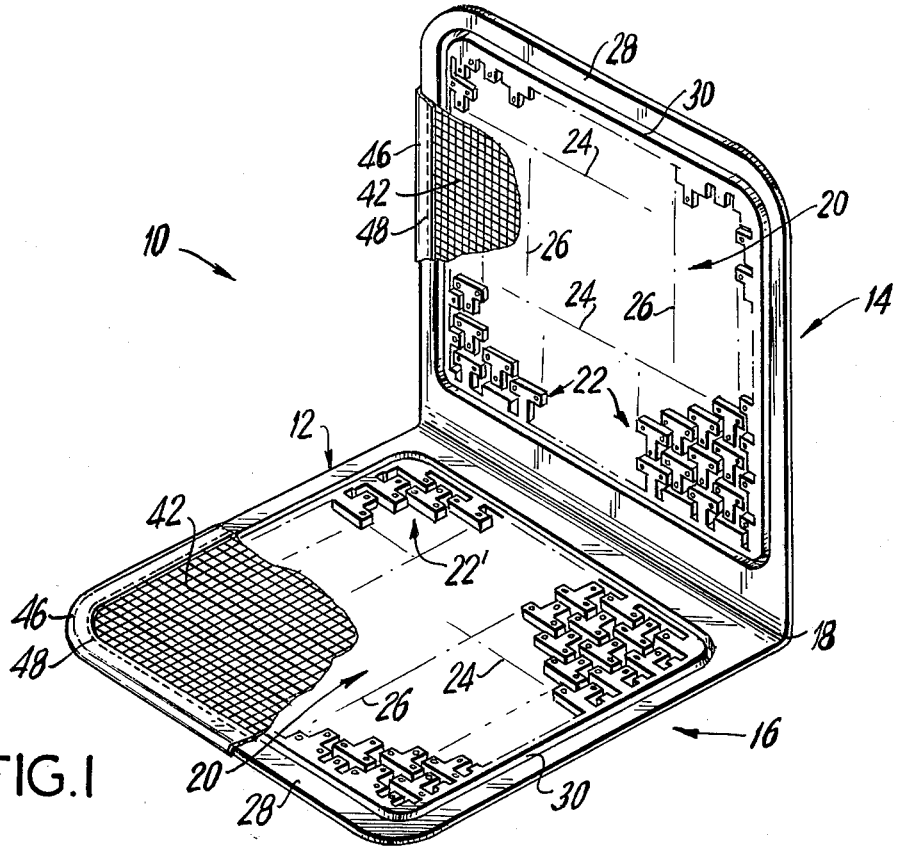
FIG. 1 is a perspective view of a car seat incorporating the support panel in accordance with the present invention, showing the mesh covering broken away to expose the T-shaped elements forming the support panel.

Referring now to the FIGURES, wherein identical or similar parts are designated by the same reference numerals throughout, and first referring to FIGS. 1–4, a car seat 10 is shown which incorporates the support panel or blank 12 in accordance to the present invention. Although a car seat is described, it will become evident that the present invention can be extended to other body support devices.

The panel 12 includes a back support portion 14 and a seat support portion 16 connected to each other at an integral hinge 18. The panel or blank 12 may be formed from any suitable material. In the presently preferred embodiment, the panel 12 is vacuum formed from a thin sheet of resilient elastomeric or plastic material.

The panel 12 is substantially rectangular in configuration, with the back and seat support portions 14 and 16 forming connected adjacent portions of the rectangular sheet. Although the back and seat support portions 14 and 16 are shown each to be generally rectangular, this does not form a critical feature of the present invention and these support portions may assume any other configuration.

Each support portion 14, 16 includes a central region or area 20, shown to be rectangular, which follows and extends proximate to the peripheral edges of the respective support portions. Provided within each central area or region 20 is a grid or array of T-shaped elements 22, 22′ arranged in rows 24 and columns 26. The elements 22 formed on the back support portion 14 and the element 22′ formed on the seat support portion 16 are shown to be identical except for the orientation thereof. However, the elements 22 and 22′ need not be identical and may differ in size and/or spacing as long as the back and seat support portions 14, 16 maintain the requisite rigidity as to be described.

The T-shaped elements 22, 22′ are three dimensional and have the thickness of the panel 12. These elements extend between and collectively define two spaced substantially parallel faces of the panel 12 as will become evident from the description that follows.

Each of the T-shaped elements 22, 22′ has a T-shaped support surface **22*a* disposed in one of the upper of the faces of the panel and has wall portions 22*b*–22*f* which are normal to the faces of the panel 12 and extend from the periphery of the T-shaped surfaces 22*a* to the other or lower face of the panel where the respective elements are connected to each other as shown and to be described. Advantageously, the wall portions 22*b*–22*f* are somewhat inclined outwardly from the support surfaces 22*a* as the wall portions extend towards the lower face of the panel. This permits the grids or blanks 12** to be stacked for storage by nesting corresponding T-shaped elements inside one another and provides a sufficient draft to facilitate mold removal.

An important feature of the present invention is that the T-shaped surfaces **22*a* are arranged in the rows 24 and columns 26 with the surfaces 22*a* in adjacent rows being staggered and intermeshed to form substantially uniform elongate transverse and longitudinal spaces 36, 37 therebetween. Elongate connecting portions 36′, 37′ collectively define the other or lower face of the panel 12 and extend between adjacent facing or opposing wall portions 22*b*–22*f* and are coextensively disposed in opposition to the elongate spaces 36, 37 to form a lattice of elongate substantially uniform width channels 38, 40, shown in FIGS. 2–4, each extending about the periphery of an associated T-shaped section 22, 22′.**

The transverse channels formed between the walls **22*b*–22*f* are designated by the reference numeral 38 and the longitudinal channels designated by the reference numerals 40. These channels, which are in effect channel segments, are oriented in directions parallel to one of the directions of said rows 24 and columns 26. An important feature of the present invention is that the elements 22, 22′ are arranged to repeatedly interrupt the continuity between both channels 38, 40 aligned along directions parallel to the rows and columns 24, 26 to enhance the stiffness of the panel 12 and prevent excessive flexing of the same along the channels 38, 40 when a person is supported on the mat or seat 10** while providing paths which permit flow of ventilating air through these channels.

Figure 3:
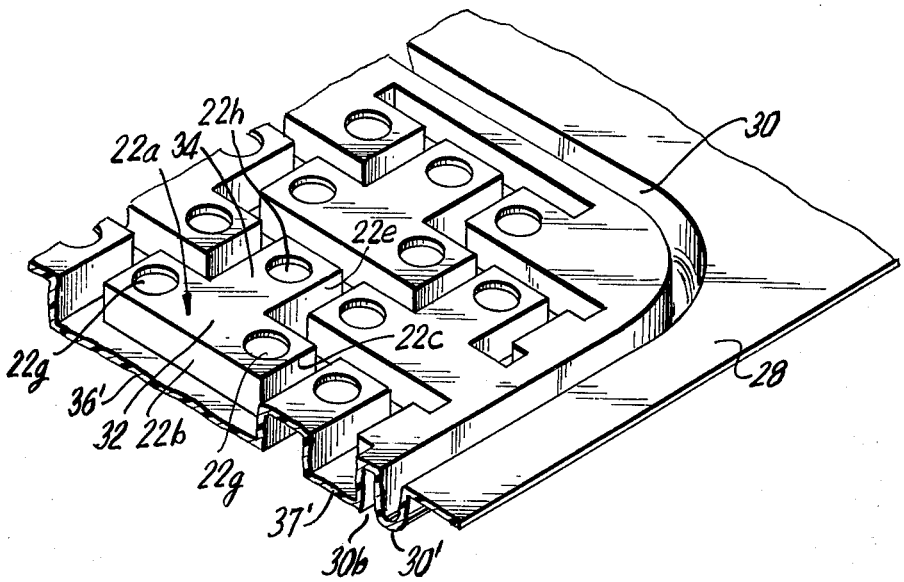
FIG. 3 is a perspective view of a corner portion of the support panel of the car seat shown in FIGS. 1 and 2.
Figure 4:
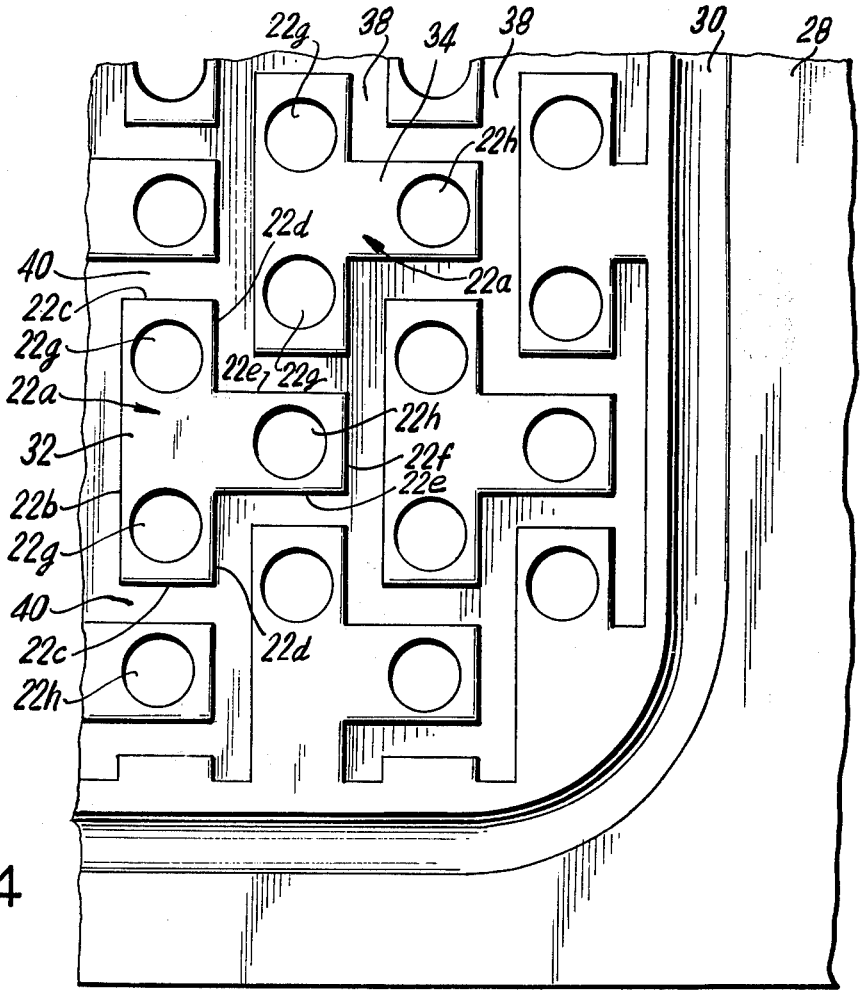
FIG. 4 is an enlarged top plan view of the corner portion shown in FIG. 3.

Referring to FIGS. 3 and 4, the details of the grid or array of T-shaped sections 22′ is shown in more detail. In the presently preferred embodiment, each of the T-shaped surfaces **22*a* comprises a transverse portion 32 and a longitudinal portion 34. In accordance with an advantageous construction of the subject panel, the width of each transverse portion 32 along the direction of said rows 24 is approximately three times the width of each of the longitudinal portions 34. In the construction under consideration, each longitudinal portion 34 has a length along the direction of the columns 26 which is approximately equal to the height of a transverse portion 32 and the width of one of the transverse channels 38. The width of the longitudinal portion 34 is approximately equal to the height of the transverse portion 32. As could best be seen in FIG. 4, the width of the transverse portion 32 is approximately equal to the width of the longitudinal portion 34 and four times the width of the longitudinal channel 40.**

For the above described construction, the distance along the direction of the rows 24 between adjacent transverse portions 32 in adjacent columns 26 is equal to the width of a longitudinal portion 34 and twice the width of the channel 40. Also, the distance along the direction of the rows 24 between adjacent longitudinal portions 34 in adjacent columns 26 is equal to the width of the transverse portion 32 and twice the width of the channel 40. The distance along the direction of the columns 26 between adjacent transverse portions 32 in adjacent rows 24 is equal to the width of the transverse portion 32 and twice the width of the channel 38. Further, the distance along the direction of the columns 26 between adjacent longitudinal portions 34 in adjacent rows 24 is equal to the width of a transverse portion 32 and the width of the channel 38.

Figure 2:
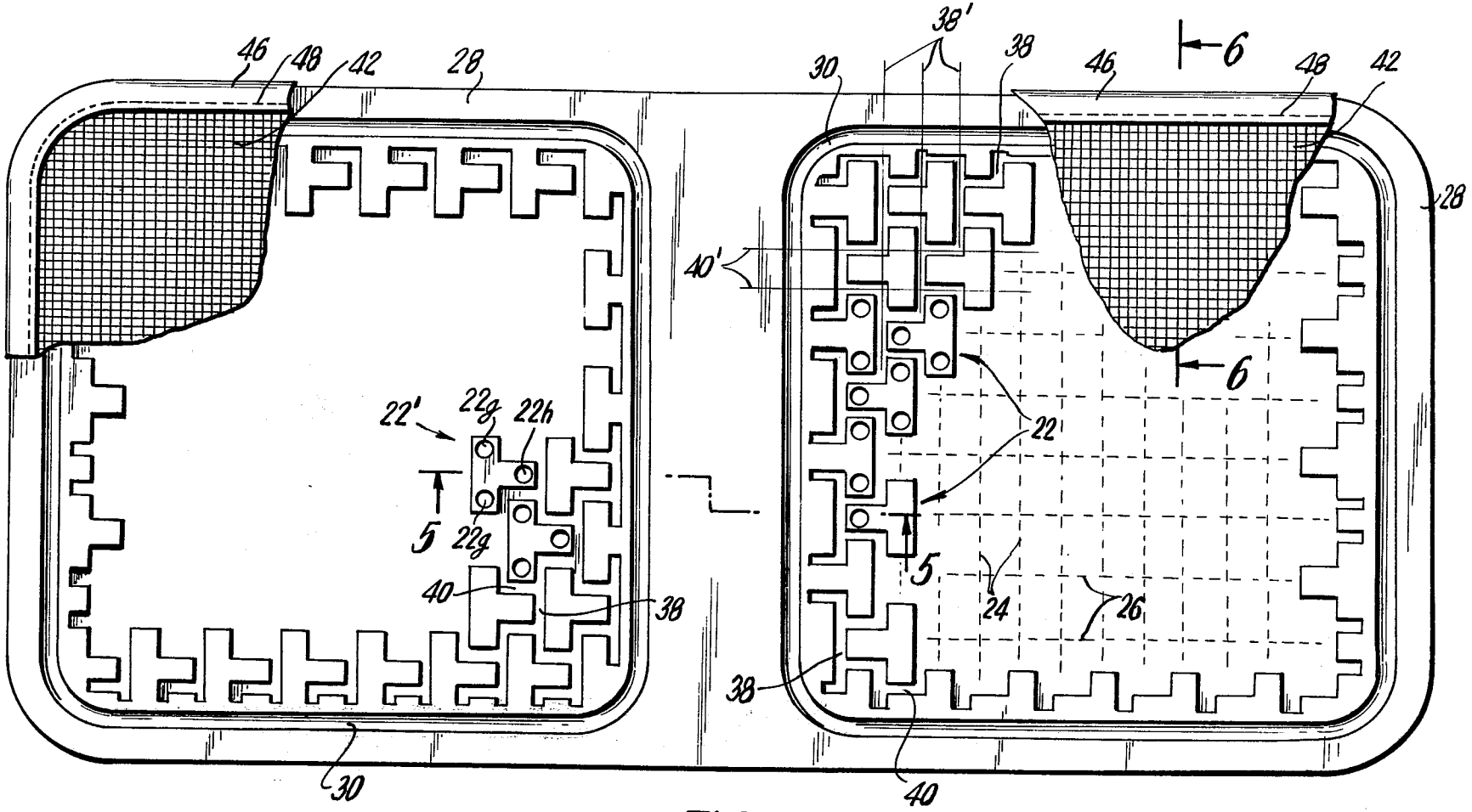
FIG. 2 is a top plan view of the car seat shown in FIG. 1.

Referring to FIG. 2, the principle of the present invention will now be described. The reference numerals 38′ designate lines parallel to the rows 24 along which channels or channel segments 38 are formed and are aligned. It will be noted that the channels 38 are repeatedly interrupted along the lines 38′ by spaced longitudinal portions 34 in every other column 26. Similarly, the reference numerals 40′ designate those lines parallel to the directions of the columns 26 along which channel or channel portions 40 are aligned. Here, the transverse portions 32 of the sections 22, 22′ in every other row are shown to repeatedly interrupt the continuity of the channels 40 along the lines 40′. Accordingly, flexing of the panel 12 along the lines 38′ and 40′ is minimized and the stiffness of the panel is substantially enhanced. Excessive flexing of the panel 12 is prevented along all directions of the panel including the longitudinal and transverse directions of the rows 24 and the columns 26 when a person is supported on the mat. However, because the channels 38 and 40 are interconnected with one another, these provide a grid of channels which permit free flow of ventilating air therethrough.

To further enhance the ventilation of air through the panel, there is advantageously provided at the free ends of the transverse portion 32 and the longitudinal portion 34 holes 22*g* and 22*h* respectively. Due to the novel construction above described, the provisions of these holes does not materially increase the flexibility of the panel and the requisite stiffness required for comfort is maintained.

Figure 5:
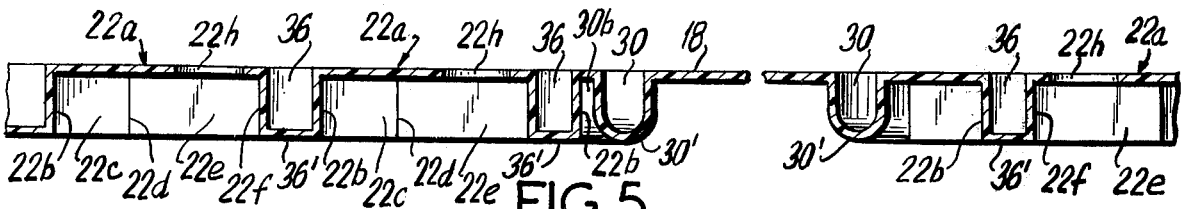
FIG. 5 is a cross sectional view of a portion of the car seat shown in FIG. 2, taken along line 5—5.

In accordance with the presently preferred embodiment, there is provided an optional continuous peripheral bead 30′ extending around each central grid area 20 which extends between the above-mentioned upper and lower faces of the panel 12 and which opens in the direction of the T-shaped surfaces 22*a*. The nature of the bead 30′ is shown in FIG. 5, wherein it is shown to define a continuous peripheral channel or groove 30 which extends about a respective grid area 20. The bead 30′ is in the nature of stiffening portion which further enhances the rigidity of the panel 12 to make the same suitable for supporting persons without excessive flexing or deformation thereof. Extending about the periphery of the panel 12, there is provided a continuous planar portion 28 disposed in the upper face or in the plane of the T-shaped surfaces 22*a*.

Clearly, the above described blank or panel 12 may be made by vacuum-forming, in which case the elongate surfaces 36′, 37′ and the bead 30′ are drawn to a common side from a sheet of deformable material. The planar peripheral portion 28 as well as the T-shaped surfaces 22*a* remain in the plane of the original sheet.

Figure 6:
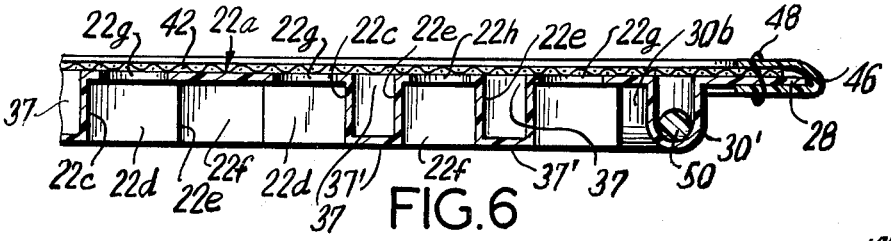
FIG. 6 is a cross sectional view of the car seat shown in FIG. 2, taken along line 6—6.

While the panel or blank 12 may alone be used as a mat or cushion, the car seat 10 in accordance with the presently preferred embodiment utilizes a covering material 42 which is also rectangular and has dimensions comparable to those of the panel 12. The material 42 and the panel 12 are coextensive with each other and the material 42 is in abutment against the support T-shaped surfaces 22*a* and is arranged to dispose the peripheral edges of the coextensive sheets 12, 42 adjacently to each other. However, as should be clear, the panel 12 may be used as shown, or may be turned upside down to dispose the connecting portions 36′, 37′ in upwardly facing directions to serve as body support surfaces. In this connection, the covering material 42 may be provided on either major side of the panel and, accordingly, be in abutment with either the support surfaces 22*a* or 36′, 37′. As shown in FIGS. 1, 2 and 6, an optional elongate strip of binding material 46 extends about the edges of the sheets 12, 42 and is folded to cover the same. Suitable connecting means are utilized for connecting these sheets 12, 42 to the strip 46 and to each other. Although stitching 48 is utilized to effect this connection, other suitable conventional means, such as staples or adhesive, may equally be used. The covering material may be a mesh material as shown, or any other suitable covering material which renders exposed surfaces of the car seat aesthetically pleasing.

As above mentioned, the car seat 10 is relatively rigid due to the basic grid construction above described of T-shaped elements 22, 22′ as well as the provision of the peripheral beads 30′. To still further enhance the stiffness of the panel, a stiffening wire 50 may be disposed within the peripheral channel 30, as shown in FIG. 6. Since the bead 30′ opens in the direction of the T-shaped surfaces 22*a*, the wire 50 is maintained within the groove or channel 30 by the sheet of mesh covering material 42. This arrangement insures that the stiffening wire 50 remains within the channel 30 and is not permitted to freely move in the space between the mesh material 42 and the panel or blank 12 as with many prior art constructions.

Figure 7:
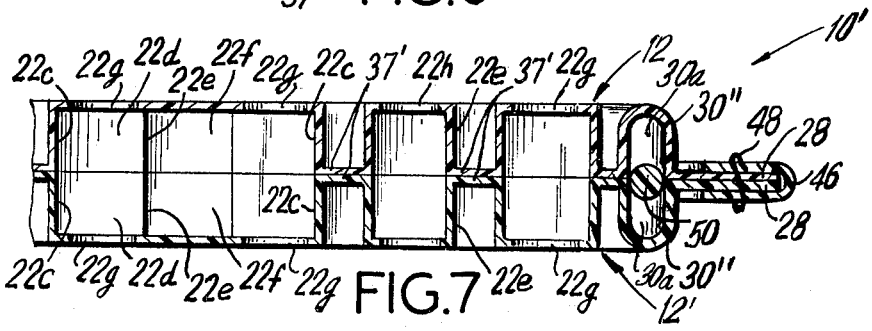
FIG. 7 is similar to FIG. 6, but showing a car seat formed with two similar support panels in accordance with the present invention.

The present invention also contemplates the use of more than one panel or blank in the formation of a body support mat such as a car seat. One possible arrangement of two panels 12 is shown in FIG. 7. Here, two panels 12′ are shown coextensively arranged to cause corresponding elongate portions 36′, 37′ to be in abutment with each other. With such an arrangement, opposing supporting T-shaped sections on the two back-to-back panels are spaced from each other a distance approximately equal to twice the thickness of the panels. Accordingly, both major surfaces of the mat 10′ exhibit the T-shaped support surfaces 22*a*. Since the grid or array of surfaces 22*a* has an aesthetically pleasing appearance, it is presently contemplated that the mat or seat 10′ is not provided with a mesh covering material 42 as described above. Thus, a driver sits directly on and is supported by the surfaces 22*a* on either panel 12′. However, it should be evident that a covering material may be used if desired.

As with the previously described mat, a strip of binding 46 is folded to cover the peripheral edges of the two panels 12′. Stitching 48 connects the panels to each other and to the binding.

The support mat 10′, having approximately twice the rigidity or stiffness of a single blank 12, is capable of supporting most anticipated loads with minimum flexing or deformation. In the event, however, that the mat 10′ is to be further reinforced, an optional wire 50 may be provided which is disposed between the two panels 12′. Where modified panels 12′ are used, having the beads 30′′ formed to expose the opening of the resulting channels in the opposite direction or in a direction away from the T-shaped surfaces 22*a*, the two aligned beads 30′′ together form a closed channel 30*a* as shown which receives the wire 50 and prevents the same from freely moving between the panels. However, a double panel mat may be formed from the panels 12 wherein the channels 30 are open in the direction of the T-shaped surfaces as described above. Here, a wire may be disposed within the spaces 30*b*, shown in FIGS. 3, 5, and 6, formed between the beads 30′ and the walls 22*b*–22*f* adjacent the respective beads.

The above described construction of the grid areas 20 is for purposes of illustration only. While the relative dimensions of the longitudinal portions 34 and the transverse portions 32, as well as the uniform spacing of the channels 38 and 40 is advantageous and forms the presently preferred embodiment, it must be pointed out that deviations from this construction may be made without departing from the spirit of the present invention. Of importance is that T-shaped elements in adjacent rows be staggered and intermeshed to form a lattice of elongate channels which extend about the periphery of the associated T-shaped sections. The sections must be so arranged that the continuity between channels which are aligned along directions parallel to the rows and columns are repeatedly interrupted. In this manner, the stiffness of the panel is enhanced and excessive flexing thereof including along the lines 38', 40' of the channels 38, 40 is prevented.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A support panel for use as a ventilated body support mat, the panel comprising an array of sections arranged in columns and rows, each of said sections including a transverse head portion and a longitudianl stem portion projecting perpendicularly from a central region of said transverse head portion to define T-shaped elements, said transverse head portions and said longitudinal stem portions being respectively directed along directions parallel to the directions of said rows and columns, said T-shaped elements extending between and collectively defining two spaced substantially parallel faces of the panel, each of said T-shaped elements having a T-shaped surface disposed in one of said faces and having wall portions substantially normal to said faces extending from the periphery of said T-shaped surface in said one face to said other face; elongate connecting portions collectively defining the other of said faces and extending between said wall portions in the other of said faces for connecting adjacent T-shaped elements, said T-shaped elements in adjacent rows being staggered and intermeshed with each longitudinal stem portion along direction of said rows being disposed between ends of adjacent transverse head portions in adjacent columns and each transverse head portion along direction of said rows being disposed between adjacent longitudinal stem portions in adjacent columns, said T-shaped elements providing a lattice of elongate substantially uniform width channels each extending about the periphery of an associated T-shaped element and oriented parallel to one of the directions of said rows and columns with the continuity between said channels aligned along the directions parallel to said rows and columns being repeatedly interrupted by said T-shaped elements, whereby the stiffness of the panel is enhanced and excessive flexing thereof is prevented along all directions along said panel including the longitudinal and transverse directions of said columns and rows respectively when a person is supported on the mat, and said channels are provided to permit the flow of ventilating air therethrough.

2. A support panel as defined in claim 1, wherein the width of each transverse portion along the direction of said rows is approximately three times the width of each longitudinal portion.

3. A support panel as defined in claim 1, wherein the panel is formed from a resilient material.

4. A support panel as defined in claim 3, wherein said material is an elastomeric plastic material.

5. A support panel as defined in claim 1, wherein holes are provided in said T-shaped surfaces at the free ends of said longitudinal and transverse portions.

6. A support panel as defined in claim 1, wherein the panel is used as a car seat and is generally rectangular and includes a first support portion and a second support portion connected by an integral hinge and each having a major central region thereof formed with said array of T-shaped elements.

7. A support panel as defined in claim 6, further comprising a continuous stiffening bead extending between said faces about each central region and being open in said one of said faces.

8. A support panel as defined in claim 7, further comprising a sheet of covering material having dimensions comparable to said panel and coextensive with the latter in abutment against said T-shaped surfaces to dispose the peripheral edges of said coextensive sheet and panel adjacently to each other; an elongate strip of binding material extending about said edges and folded to cover the same; and connecting means for connecting said sheet and panel to said strip and to each other.

9. A support panel as defined in claim 8, wherein said covering material is a mesh material.

10. A support panel as defined in claim 8, wherein said bead forms a continuous groove open in the direction of said one of said faces; and further comprising a stiffening wire disposed within said groove, said wire being maintained within said groove by said sheet of covering material.

11. A support panel as defined in claim 1, wherein the panel comprises two similarly formed rectangular sheets of material arranged coextensively with each other with corresponding connecting portions on the two sheets being in abutment with each other and corresponding T-shaped surfaces being spaced in opposition to each other and spaced a distance approximately twice the spacing between said faces; and connecting means for maintaining said sheets fixed in relation to each other.

12. A support panel as defined in claim 11, further comprising a continuous stiffening bead extending between the faces of each respective sheet about each major central area and open in the other of said faces to form continuous grooves, opposing grooves in said sheets together forming continuous closed channels; and stiffening wires maintained within said closed channels to reinforce the panel.

13. A support panel as defined in claim 11, further comprising a continuous stiffening bead extending between the faces of each respective sheet about each major central area to form wire-receiving spaces with adjacent wall portions of said T-shaped elements; and stiffening wires disposed within said wire-receiving spaces to reinforce the panel.

* * * * *